US007690154B2

(12) United States Patent
Muir

(10) Patent No.: US 7,690,154 B2
(45) Date of Patent: Apr. 6, 2010

(54) CHANNEL-MOUNTED 4-BAR LINKAGE ASSEMBLY

(75) Inventor: Malcolm Muir, Honeoye Falls, NY (US)

(73) Assignee: Advantage Manufacturing Corporation, Victor, NY (US)

( * ) Notice: Subject to any disclaimer, the term of this patent is extended or adjusted under 35 U.S.C. 154(b) by 1187 days.

(21) Appl. No.: 10/908,696

(22) Filed: May 23, 2005

(65) Prior Publication Data

US 2006/0265957 A1 Nov. 30, 2006

(51) Int. Cl.
*E05F 11/28* (2006.01)

(52) U.S. Cl. ..... 49/345; 49/346; 49/246; 49/250

(58) Field of Classification Search ..... 49/345, 49/346, 246, 248, 250
See application file for complete search history.

(56) References Cited

U.S. PATENT DOCUMENTS

| | | | | |
|---|---|---|---|---|
| 2,154,716 | A | 4/1939 | Anderson | |
| 3,229,323 | A | 1/1966 | Hensgen | |
| 3,413,761 | A | 12/1968 | Proni | |
| 4,304,027 | A | 12/1981 | Di Fazio | |
| 4,364,201 | A | 12/1982 | Taylor | |
| 4,571,776 | A | 2/1986 | Taylor | |
| 4,635,399 | A | 1/1987 | Gehrke et al. | |
| 4,639,971 | A | 2/1987 | Kurtz | |
| 4,662,553 | A | 5/1987 | Grosjean | |
| 4,674,149 | A | 6/1987 | Vetter | |
| 4,790,106 | A | 12/1988 | La See | |
| 5,074,075 | A | 12/1991 | Lee See | |
| 5,083,344 | A | 1/1992 | Pettit et al. | |
| 5,093,960 | A | 3/1992 | Pemberton | |
| 5,255,471 | A * | 10/1993 | Shaw et al. | 49/252 |
| 5,640,813 | A | 6/1997 | Glazik et al. | |
| 5,711,052 | A | 1/1998 | Delaske | |
| 5,815,992 | A | 10/1998 | Wells et al. | |
| 5,898,977 | A | 5/1999 | Muir | |
| 6,434,887 | B2 | 8/2002 | Nakanishi et al. | |
| 6,442,898 | B1 | 9/2002 | Wu | |

(Continued)

FOREIGN PATENT DOCUMENTS

| | | | |
|---|---|---|---|
| GB | 2184481 | A | 6/1987 |

(Continued)

OTHER PUBLICATIONS

International Search Report for PCT/US2006/000080, mailed by the European Patent Office on May 24, 2006.

*Primary Examiner*—Gregory J. Strimbu
(74) *Attorney, Agent, or Firm*—Stephen B. Salai, Esq.; Thomas B. Ryan, Patent Agent; Harter Secrest & Emery LLP

(57) ABSTRACT

A 4-bar linkage assembly for mounting a sash to a frame member of a window assembly. The linkage assembly including a vent bar having an offset portion and a base portion that fits within a sash channel of the sash. The vent bar includes a fixed connection extending between the offset portion and the base portion for supporting the offset portion and projecting between overhanging rails of the sash channel. The offset portion forms a stop which engages an end of the sash channel for locating the vent bar within the sash channel.

18 Claims, 3 Drawing Sheets

U.S. PATENT DOCUMENTS

| | | | | |
|---|---|---|---|---|
| 6,560,934 | B1 | 5/2003 | Workman | |
| 7,047,600 | B2 * | 5/2006 | Muir | 16/366 |
| 2003/0213100 | A1 | 11/2003 | Brain et al. | |

FOREIGN PATENT DOCUMENTS

| | | | |
|---|---|---|---|
| GB | 2233706 | A | 1/1991 |
| GB | 2 258 268 | A | 2/1993 |
| GB | 2258267 | A | 2/1993 |
| GB | 2318613 | A | 4/1998 |

* cited by examiner

CHANNEL-MOUNTED 4-BAR LINKAGE ASSEMBLY

TECHNICAL FIELD

Within the field of window hardware, the invention relates to linkage assemblies for pivotally mounting sashes within frames and, more particularly, to adapting 4-bar linkage assemblies to the constraints of conventional channel mounts for anchoring hardware components.

BACKGROUND OF INVENTION

A standardized mounting system for attaching window hardware and accessory options to sashes and frames of window assemblies features elongated channels referred to as "Euro-Grooves". The channels have a T-shaped cross section, comprising a channel bottom and two sidewalls with overhanging rails. Hardware can be slid along the channels to desired positions and anchored to the overhanging rails of the sidewalls.

Although many benefits accrue from such standardized mounting systems, the channels can impose clearance limitations, particularly for linkages that support pivotal and translational motions of casement windows. For example, such channels can provide strong anchors for securing conventional 4-bar linkages to mating sashes and frames of casement windows, but the opposing channels between the sashes and frames can limit the space available for accommodating a stack height of the linkages.

The clearance problem can sometimes be resolved by reducing the thickness of individual bars of the linkages so that the collective stack height of the bars matches the available space. However, this solution is not workable for some heavy-duty applications, where the demands on the linkages are severe. In such instances, the removal of one or more of the channels may be needed to establish the required space.

SUMMARY OF INVENTION

The invention features a linkage assembly, which among its various embodiments incorporates adaptations for exploiting advantages of the "Euro-Groove" mounting system while overcoming attendant clearance limitations. The embodiments include 4-bar linkage assemblies in which modified vent bars engage conventional mounting channels. A base portion of one such vent bar slides within the conventional channel, an offset portion of the same bar abuts one end of the channel sidewalls, and a fixed connection between the base and offset portions projects through overhanging side rails of the channel. A spacing feature provides rotational clearance between the intermediate linkage and the sidewalls, supporting rotation of the intermediate linkage with respect to the vent bar mounted within the channel. Thus, the modified linkages can be both anchored to and located along conventional mounting channels, while preserving the intended functions and desired thicknesses of their linkage bars.

One version of the invention as a linkage assembly for pivotally mounting a sash to a frame includes a vent bar that is slidable within a channel of the sash into a fixed mounting position. The vent bar has a length that can be oriented along the sash channel and a width that can be overhung by sidewalls the sash channel. One end of an intermediate linkage pivotally connects to the vent bar. A track is attachable to a channel of the frame, and a shoe slides along the track. Another end of the intermediate linkage pivotally connects to both the track and the shoe. A spacing feature provides rotational clearance between the intermediate linkage and the sidewalls of the sash channel in support of a rotation of the intermediate linkage with respect to the vent bar mounted within the sash channel.

The intermediate linkage pivotally connects to the vent bar about first and second pivot axes, and the spacing feature is preferably a first of two spacing features. The first of the two spacing features provides rotational clearance along the first pivot axis between the intermediate linkage and the sidewalls of the sash channel, and a second of the two spacing features provides rotational clearance along the second pivot axis between the intermediate linkage and the sidewalls of the sash channel. The first spacing feature, which preferably takes the form of a bushing, fits between the sidewalls of the sash channel. The first and second spacing features locate the intermediate linkage with respect to the vent bar in a position for overlying the sidewalls of the sash channel.

An offset portion of the vent bar preferably forms the second spacing feature. A connection between the offset portion of the vent bar and a remaining base portion of the vent bar can be narrowed to provide clearance for projecting between the overhanging portions of the sidewalls. The offset portion of the vent bar can be formed as a tip at one end of the vent bar for engaging an end cap mounted on the track. The tip also forms a stop for locating the vent bar at the fixed mounting position along the sash channel. The connection can be formed by a bend in the vent bar that is relieved (e.g., notched) for projecting between the overhanging portions of the sidewalls. The stop can be formed by a land on the offset portion adjacent to the relieved bend in the vent bar. The stop engages an end of the sash channel.

Another version of the invention as a window mounting system includes a track attachable to a channel formed in a frame and a vent bar slidable along a channel formed in a sash. A shoe slides along the track. An intermediate linkage connects the vent bar to both the track and the shoe. The vent bar has a base portion that is overhung by sidewalls of the sash channel and an offset portion that supports a pivotable connection to the intermediate linkage. A fixed connection between the offset portion of the vent bar and the base portion of the vent bar is narrowed with respect to the base portion of the vent bar for projecting between the overhanging portions of the sash channel sidewalls.

The offset portion of the vent bar preferably includes a stop positioned for engaging at least one of the sidewalls of the sash channel. The fixed connection is also preferably narrowed with respect to the offset portion of the vent bar, and the stop is preferably formed in the offset portion at an intersection with the fixed connection. The stop can be positioned for engaging the sidewall at one end of the sash channel.

The offset portion of the vent bar also preferably includes a tip formed at one end of the vent bar for engaging a camming surface at one end of the track. The offset portion can be spaced from the base portion of the vent bar in a position that provides rotational clearance between the intermediate linkage and the sidewalls of the sash channel. The base portion of the vent bar also supports a pivotable connection to the intermediate linkage. A spacing feature between the base portion of the vent bar and the intermediate linkage can be sized for projecting between the overhanging portions of the sidewalls of the sash channel. The spacing feature provides rotational clearance between the intermediate linkage and the sidewalls of the sash channel in support of a rotation of the intermediate linkage with respect to the vent bar mounted within the sash channel.

The intermediate linkage preferably includes a first link connecting the offset portion of the vent bar to the shoe, a second link connecting the base portion of the vent bar to the track, and a third link connecting the first and second links. The spacing feature can be formed as a spacer between the base portion of the vent bar and the second link. Preferably, the spacer has a thickness not less than a thickness of the overhanging portions of the channel sidewalls and is sized in width to fit between the overhanging portions of the channel sidewalls.

Yet another version of the invention as a window assembly includes channels in both a frame and a sash for mounting hardware. The sash channel has a channel bottom and sidewalls that include overhanging portions that overhang the channel bottom. The frame channel and the sash channel define a limited clearance between positions of overlap. A track is anchored to the frame channel, and a shoe slides along the track. A vent bar located along the sash channel has a base portion overhung by the overhanging portions of sidewalls. An intermediate linkage connects the vent bar to both the track and the shoe. A spacing feature provides rotational clearance between the intermediate linkage and the sidewalls of the sash channel in support of a rotation of the intermediate linkage with respect to the vent bar.

The spacing feature preferably is preferably spacer that is located along a pivot axis between the base portion of the vent bar and the intermediate linkage and has a thickness not less than a thickness of the overhanging portions of the sidewalls. The vent bar preferably includes an offset portion supporting a pivotable connection with the intermediate linkage. Preferably, a fixed connection between the base portion of the vent bar and the offset portion of the vent bar is narrowed with respect to the base portion of the vent bar and projects between the overhanging portions of the sidewalls. The preferred offset portion includes a stop that engages one end of the sash channel for positioning the vent bar along the sash channel.

DETAILED DESCRIPTION

Figure 1:
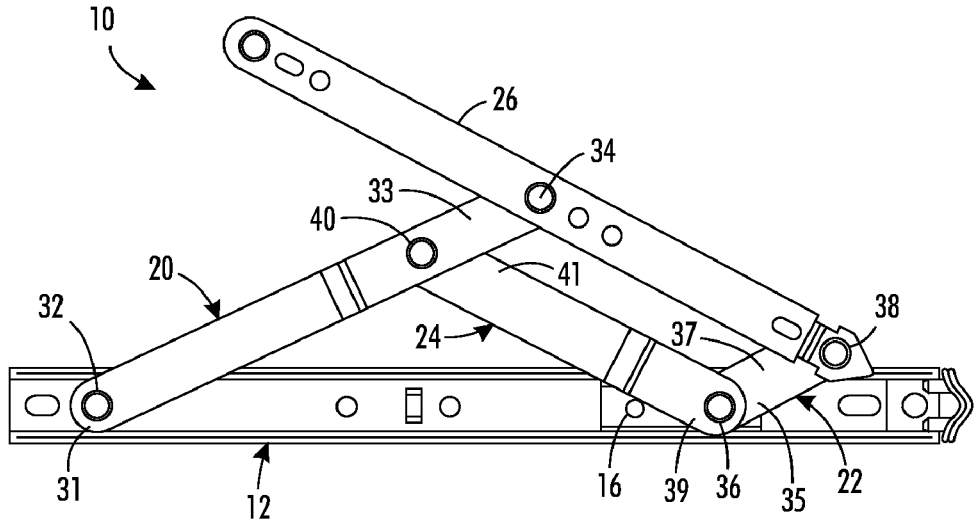
FIG. 1 is a plan view of a 4-bar linkage assembly adapted in accordance with the invention and shown in a partly open position.

Referring to the drawing figures and in particular to FIG. 1, a 4-bar linkage assembly 10 of the type contemplated by this invention, includes a track 12 having a channel 14 along which a shoe 16 is guided for translation (i.e., slides) along a limited length of the channel 14. Intermediate linkage bars 20, 22, and 24 connect the track 12 to a vent bar 26. The shoe 16 is preferably made out of brass together with a resin friction-adjusting pad, but all of the linkages including the track 12, the vent bar 26, and the intermediate linkage bars 20, 22, and 24 are preferably made of stainless steel. The choice of materials can be made in accordance with requirements of the design and is not a limitation of the invention.

Intermediate linkage bar 20 has a first end 31 that is attached by way of a pivot pin 32 to the track 12 and a second end 33 that is attached by way of a pivot pin 34 to the vent bar 26. Similarly, the intermediate linkage bar 22 has a first end 35 that is attached by way of a pivot pin 36 to the shoe 16 and a second end 37 that is attached by way of a pivot pin 38 to the vent bar 26. The intermediate linkage bar 24 interconnects the other two intermediate linkage bars 20 and 22, sharing the pivot pin 36 with the linkage bar 22 at a first end 39 but attaching to an intermediate length of the linkage bar 20 by way of another pivot pin 40 at a second end 41.

Figure 2:
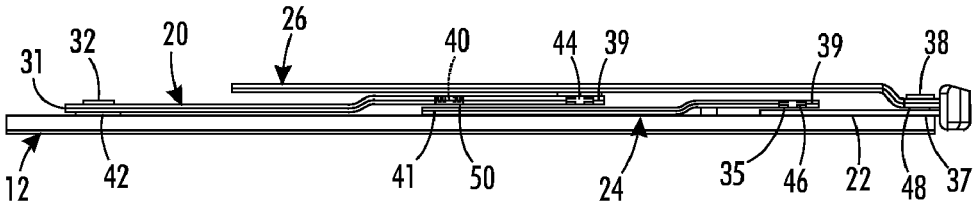
FIG. 2 is a side view of the same 4-bar linkage assembly shown in a closed position showing overlapping bars of the assembly.

As shown in FIG. 2, the first ends 31 and 35 of the linkage bars 20 and 22 are elevated at a first level above the track 12. A spacer 42 surrounding the pivot pin 32 elevates the first end 31 of the linkage bar 20 above the channel bottom 14 of the track 12. The first end 35 of the linkage bar 22 rides directly on the shoe 16 or through the intermediacy of a thin friction-reducing washer (not shown). The second end 33 of the linkage bar 20 and the first end 39 of the linkage bar 24 occupy a second level. A thin friction-reducing washer 46 around the pivot pin 36 separates the first ends 35 and 39 of the linkage bars 22 and 24. A thin friction-reducing washer 50 around the pivot pin 40 separates the second end 41 of the linkage bar 24 from an intermediate portion of the linkage bar 20. The vent bar 26 occupies the remaining third and fourth levels. Spacers 44 and 48 elevate the vent bar and are described in more detail below.

The pivot pins 32, 34, 36, 38, and 40 are preferably formed as rivets with heads recessed within the linkage bars 20, 22, and 24 and the vent bar 26 to avoid interference between the linkage bars or other neighboring structures. The spacers 42, 44, and 48 can be formed similar to the friction-reducing washers 46 and 50, differing only in thickness. The designation of spacer is applied where more than a minimum thickness is required to provide rotational clearance.

Figure 3:
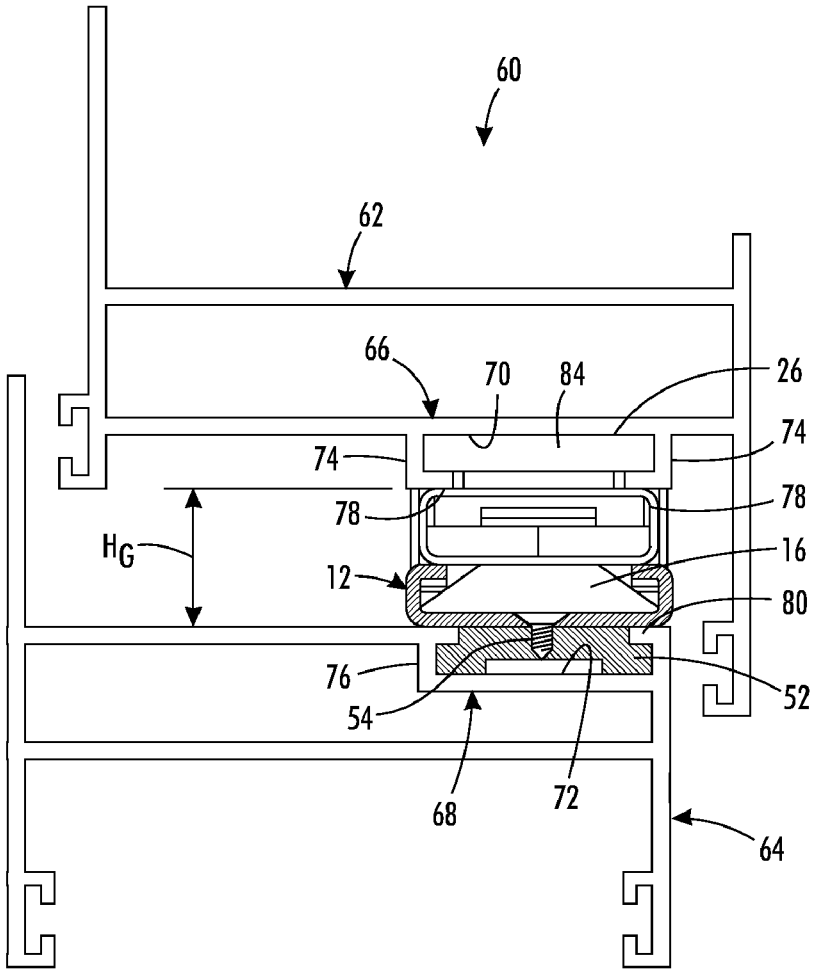
FIG. 3 is an end view of the 4-bar linkage mounted between channels incorporated into a sash and frame of a casement window.

The 4-bar linkage assembly 10 is adapted as shown in FIG. 3 to interconnect a sash 62 with a frame 64 of a casement window 60 in support of opening and closing the sash 62 within the frame 64. Both the sash 62 and the frame 64 can be constructed from aluminum extrusions or made from other common materials within the window art. A "Euro-Groove" mounting channel 66 is formed in the sash 62, and another "Euro-Groove" mounting channel 68 is formed in the frame 64 to provide conventional window hardware mounts. Both "Euro-Groove" mounting channels 66 and 68 include elongated channel bottoms 70 and 72 and two sidewalls 74 and 76 with overhanging rails 78 and 80. In cross section, the mounting channels 66 and 68 appear as T-shaped slots with the overhanging rails 78 and 80 overhanging portions of the channel bottoms 70 and 72 for confining mating features of the window hardware within the channels.

The track 12 attaches to the mounting channel 68 of the frame 64 in a conventional manner through a bracket 52 that extends along the mounting channel 68. Screws 54, which extend through openings in the track 12 into threaded engagements with the bracket 52, draw the bracket 52 and the track 12 together against the overhanging rails 80 of the mounting channel 68.

Figure 4:
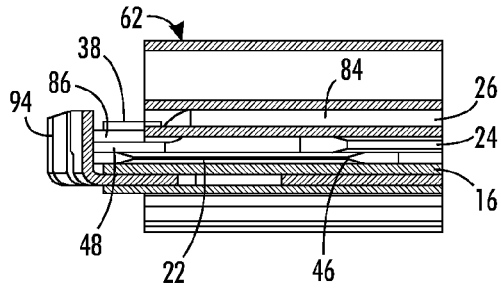
FIG. 4 is a cut-away side view showing one end of the linkage assembly engaged with the sash channel.
Figure 5:
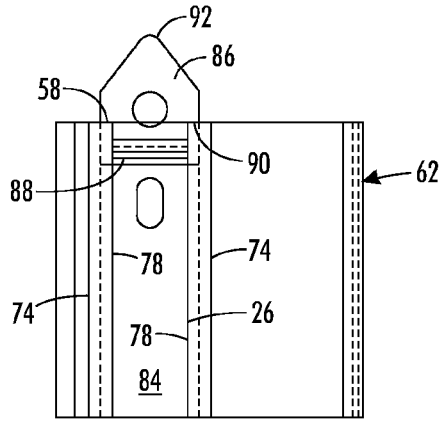
FIG. 5 is a plan view showing an engagement of one end of a vent bar of the linkage assembly with the sash channel.
Figure 6:
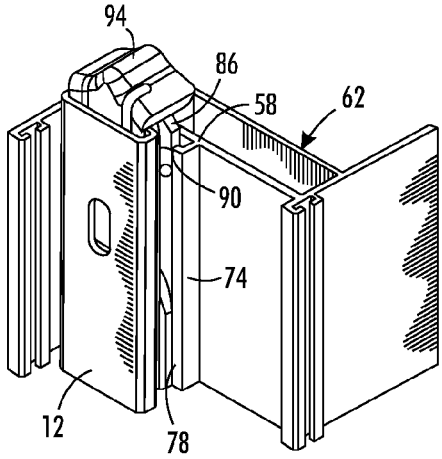
FIG. 6 is a perspective view of the one end of the linkage assembly mounted to the sash.

In contrast, the vent bar 26, as shown more clearly in FIGS. 4-6, includes a base portion 84 that makes a sliding fit within the mounting channel 66 of the sash 62 and offset portion 86 at one end of the vent bar 26 that extends beyond one end 58 of the channel 66. A fixed connection 88 is made between the base portion 84 and the offset portion 86 by a bend in the vent bar 26. The overhanging rails 78 of the mounting channel 66 overhang the base portion 84 as a constraint. However, the fixed connection 88 is notched, relieved, or otherwise narrowed to project between the overhanging rails 78 for elevating the offset portion 86 of the vent bar 26 above the sidewalls 74 of the mounting channel 66. A stop 90 is formed by the offset portion 86 at an intersection with the fixed connection 88 for engaging the one end 58 of the mounting channel 66. The stop 90 locates the vent bar 26 in a desired position within the sash 62.

The spacer 44 is sized in thickness to separate the second end 33 of the intermediate linkage bar 20 from the vent bar 26 by an amount that provides rotational clearance between the linkage bar 20 and the sidewalls 74 of the mounting channel 66. The spacer 48 fills a space between the offset portion 86 of the vent bar 26 and the second end 37 of the intermediate linkage bar 22. A further offset of the offset portion 86 could make the spacer 48 unnecessary, but the offset of the offset portion 86 is preferably limited for engaging the end 58 of the mounting channel 66 as the stop 90.

The linkage assembly 10, as adapted in accordance with the invention, occupies space (see FIG. 3) within the mounting channel 66 beyond the usual space afforded by the hinge gap HG between the mounting channels 66 and 68. The additional space allows the various components and linkage bars of the linkage assembly 10 to be formed at desired thicknesses in support a range of window applications, including heavy-duty applications such as for commercial purposes.

The offset portion 86 of the vent bar 26 also includes a tip 92 at its open end shaped for engaging an end cap 94 at one end of the track 12. The end cap 94 includes a camming surface that functions as a dual-sided containment structure to assure that the sash 62 fits tightly against the frame 64 in a closed position and opens without binding. The base portion 84 of the vent bar 26 adjacent to the fixed connection 88 can be swaged or otherwise altered to make a more secure frictional connection to the mounting channel 66. Screws (not shown) through openings in the vent bar 26 can be used to secure the vent bar 26 to the mounting channel 66. Additional details of a 4-bar linkage assembly capable of adaptation for the purposes of the present invention are disclosed in co-assigned U.S. Pat. No. 5,898,977 to the present inventor, which is hereby incorporated by reference.

Although described above in its preferred form, the invention is capable of various modifications in accordance with the overall teaching of the invention including making similar adaptations to other linkage structures for better exploiting hardware mounting channels for both in-swing and out-swing window assemblies.

What is claimed is:

1. A window mounting system, comprising:

a track attachable to a channel formed in a frame;

a vent bar slidable along a channel formed in a sash;

a shoe slidable along the track;

an intermediate linkage connecting the vent bar to both the track and the shoe;

the vent bar including a base portion that is sized to be overhung by overhanging portions of sidewalls of the sash channel and an offset portion that supports a pivotable connection to the intermediate linkage the base portion and the offset portion each being disposed in a plane, said planes being spaced apart and parallel to each other;

the vent bar including a fixed connection extending between and at an angle to both the offset portion of the vent bar and the base portion of the vent bar, the fixed connection having a width which is less than a width of each of the offset portion and the base portion of the vent bar thereby forming notches in sides of the vent bar for projecting in between the overhanging portions of the sidewalls of the sash channel, the offset portion of the vent bar forms a stop, and the stop being positioned with respect to the base portion of the vent bar for engaging an end of the sash channel.

2. The system of claim 1 in which the base portion of the vent bar includes an engagement feature for engaging the sidewalls of the sash channel for holding the vent bar in place along the sash channel.

3. The system of claim 2 in which the engagement feature supports a frictional engagement with the channel sidewalls.

4. The system of claim 1 in which the spacing between the offset portion and the base portion of the vent bar is for providing rotational clearance between the intermediate linkage and the sidewalls of the sash channel.

5. The system of claim 4 in which the base portion of the vent bar also supports a pivotable connection to the intermediate linkage.

6. The system of claim 5 further comprising a spacing feature between the base portion of the vent bar and the intermediate linkage projecting between the overhanging portions of the sidewalls of the sash.

7. The system of claim 6 in which the spacing feature provides rotational clearance between the intermediate linkage and the sidewalls of the sash channel.

8. The system of claim 7 in which the intermediate linkage includes a first link connecting the offset portion of the vent bar to the shoe and a second link connecting the base portion of the vent bar to the track.

9. The system of claim 8 in which the intermediate linkage includes a third link connecting the first and second links.

10. The system of claim 8 in which the spacing feature is formed as a spacer between the base portion of the vent bar and the second link.

11. The system of claim 10 in which the spacer has a thickness not less than a thickness of each of the overhanging portions of the channel sidewalls and is sized in width to fit between the overhanging portions of the channel sidewalls.

12. The system of claim 11 in which the spaced feature further comprises spacer is located between the offset portion and the first link.

13. The system of claim 1 in which the stop is arranged for engaging the overhanging portions of the sidewalls.

14. The system of claim 1 in which the offset portion of the vent bar also includes a tip formed at one end of the vent bar for engaging a camming surface at one end of the track.

15. A window assembly, comprising:

a frame having a channel;

a sash having a channel;

the sash channel having a channel bottom and sidewalls that include overhanging portions that overhang the channel bottom;

a track anchored to the frame channel;

a shoe slidable along the track;

a vent bar located in the sash channel and having a base portion overhung by the overhanging portions of the sidewalls;

an intermediate linkage connecting the vent bar to both the track and the shoe;

the vent bar also having an offset portion that supports a pivotable connection to the intermediate linkage the base portion and the offset portion each being disposed in a plane, said planes being spaced apart and parallel to each other, a spacing feature providing a clearance between the intermediate linkage and the sidewalls of the sash channel, the bar including a fixed connection extending between and at an angle to both the offset portion of the vent bar and the base portion of the vent bar, the fixed connection having a width which is less than a width of each of the offset portion and the base portion of the vent bar thereby forming notches in sides of the vent bar such that the fixed connection projects in between the overhanging portions of the sidewalls of the sash channel, the offset portion of the vent bar forms a stop, and the stop being positioned in engagement with an end of the sash channel for locating the vent bar in the sash channel.

16. The assembly of claim 15 in which the spacing feature is sized for projecting between the overhanging portions of the sidewalls of the sash channel.

17. The assembly of claim 16 in which the spacing feature is a spacer located between the base portion of the vent bar and the intermediate linkage and has a thickness not less than a thickness of each of the overhanging portions of the sidewalls.

18. The assembly of claim 15 in which the stop engages the overhanging portions of the sidewalls at the end of the sash channel for locating the vent bar in a desired position in the sash channel.

* * * * *